US009688081B1

(12) United States Patent
Zengo et al.

(10) Patent No.: US 9,688,081 B1
(45) Date of Patent: Jun. 27, 2017

(54) DROPLET DRYING DEVICE AND IMAGE FORMING APPARATUS

(71) Applicant: FUJI XEROX CO., LTD., Tokyo (JP)

(72) Inventors: Takeshi Zengo, Kanagawa (JP); Jun Isozaki, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/232,916

(22) Filed: Aug. 10, 2016

(30) Foreign Application Priority Data

Jan. 18, 2016 (JP) ..... 2016-007213

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS 4,469,026 A 9/1984 Irwin
5,816,165 A * 10/1998 Huston ..... B65H 26/06 101/485
5,852,745 A * 12/1998 Fontal ..... G06K 17/00 710/15
2009/0167794 A1 7/2009 Hosono et al.
2012/0200885 A1* 8/2012 Matsuzawa ..... B41J 11/46 358/1.15
2013/0265359 A1* 10/2013 Sugaya ..... B41J 11/002 347/16
2015/0158311 A1 6/2015 Ogasawara et al.

FOREIGN PATENT DOCUMENTS

JP 2002-011860 1/2002
JP 2005-178093 7/2005
JP 2009-160920 7/2009

OTHER PUBLICATIONS

Abstract and machine translation of JP 2002-011860.
Othce action in corresponding Australia patent application No. 2016216609 dated May 5, 2017.
English language machine translation of JP 2005-178093.

* cited by examiner

*Primary Examiner* — Julian Huffman
(74) *Attorney, Agent, or Firm* — Fildes & Outland, P.C.

(57) ABSTRACT

There is provided a droplet drying device including: a light source that irradiates, with light, and dries a droplet ejected to a recording medium by a forming unit that ejects the droplet to form an image; a reading unit that reads a specifying image in which a light emitting condition of the light source is specified and which is formed by the forming unit in a region out of an image forming region on the recording medium; and a light source controller that controls the light source such that the light source emits light in accordance with the light emitting condition specified in the specifying image read by the reading unit so as to irradiate the droplet with the light.

13 Claims, 9 Drawing Sheets

FIG. 8C

| LIGHT EMITTING BLOCK NUMBER | PERIOD OF START TIME 1 (msec) | PERIOD OF LIGHT EMISSION TIME 1 (msec) | INTENSITY OF LIGHT EMISSION 1 (%) | PERIOD OF START TIME 2 (msec) | PERIOD OF LIGHT EMISSION TIME 2 (msec) | INTENSITY OF LIGHT EMISSION 2 (%) |
|---|---|---|---|---|---|---|
| 6 | 2 | 10 | 80 | 4 | 10 | 80 |
| ... | | | | | | |
| 9 | 0 | 0 | 0 | 0 | 0 | 0 |
| ... | | | | | | |
| 12 | 2 | 10 | 100 | 4 | 5 | 50 |
| ... | | | | | | |
| 16 | 2 | 10 | 50 | 0 | 0 | 0 |

DROPLET DRYING DEVICE AND IMAGE FORMING APPARATUS

CROSS-REFERENCE TO RELATED APPLICATIONS

This application is based on and claims priority under 35 USC 119 from Japanese Patent Application No. 2016-007213 filed Jan. 18, 2016.

BACKGROUND

Technical Field

The present invention relates to a droplet drying device and an image forming apparatus.

SUMMARY

According to an aspect of the invention, there is provided a droplet drying device including:

a light source that irradiates, with light, and dries a droplet ejected to a recording medium by a forming unit that ejects the droplet to form an image;

a reading unit that reads a specifying image in which a light emitting condition of the light source is specified and which is formed by the forming unit in a region out of an image forming region on the recording medium; and a light source controller that controls the light source such that the light source emits light in accordance with the light emitting condition specified in the specifying image read by the reading unit so as to irradiate the droplet with the light.

BRIEF DESCRIPTION OF THE DRAWINGS

Exemplary embodiments of the present invention will be described in detail based on the following figures, wherein:

FIGS. 8A to 8C are views depicting a timing patch according to a third exemplary embodiment.

DETAILED DESCRIPTION

Hereinafter, exemplary embodiments of the invention will be described in detail with reference to the drawings. Note that an example, in which an image forming apparatus according to an exemplary embodiment of the invention is applied to an inkjet type image forming apparatus, exemplifies the exemplary embodiment.

First Exemplary Embodiment

First, a configuration of an image forming apparatus 10 according to the exemplary embodiment is described with reference to FIGS. 1A to 2.

Figure 1A:
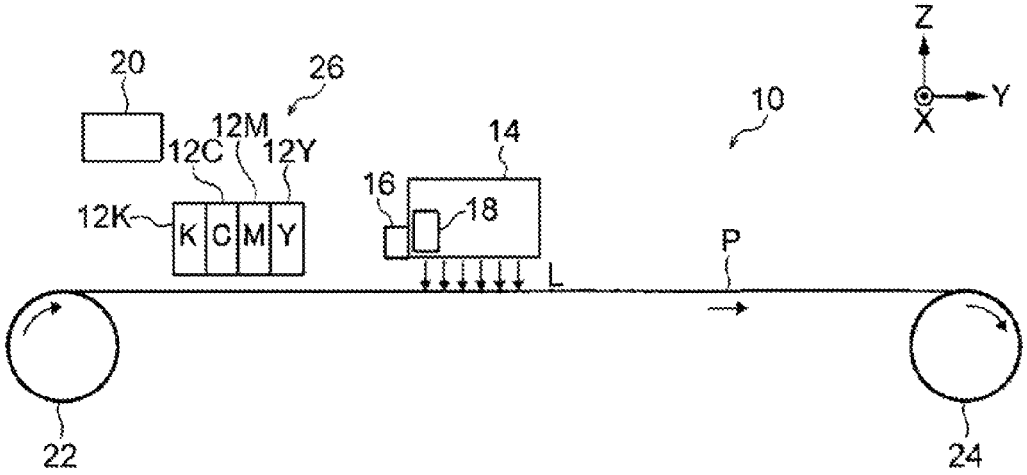
FIGS. 1A and 1B are views showing an example of a configuration of an image forming apparatus according to an exemplary embodiment and showing an example of a configuration of a droplet drying device.
Figure 2:
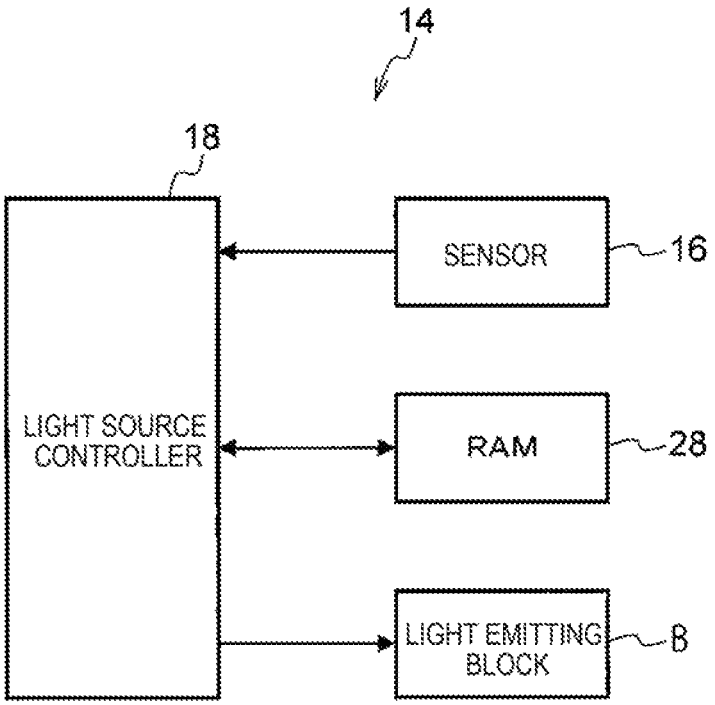
FIG. 2 is a functional block diagram showing an example of a configuration of an electric system of the droplet drying device according to the exemplary embodiment.

As shown in FIG. 1A, the image forming apparatus 10 includes a head unit 26 as a forming unit, a droplet drying device 14, a controller 20, a feed roll 22, and a winding roll 24. The image forming apparatus 10 has a function of forming an image on a front surface of continuous paper (paper roll) P as a recording medium, in addition to an image on a rear surface thereof as necessary. The droplet drying device 14 according to the exemplary embodiment includes a light source controller 18 and a sensor 16 as a reading unit.

The head unit 26 includes an inkjet head 12K that ejects an ink droplet (example of a droplet) to the continuous paper P and forms a black (K) image, an inkjet head 12C that forms a cyan (C) image, an inkjet head 12M that forms a magenta (M) image, and an inkjet head 12Y that forms a yellow (Y) image. The inkjet head 12K, the inkjet head 12C, the inkjet head 12M, and the inkjet head 12Y are aligned to face the continuous paper P in this order from an upstream side to a downstream side in a transporting direction (in FIG. 1A, a +Y direction represented by an arrow below reference sign P, hereinafter, referred to as a "paper transporting direction") of the continuous paper P.

Note that the order of the alignment of the inkjet head 12K, the inkjet head 12C, the inkjet head 12M, and the inkjet head 12Y is described as an example and is not limited to the order in FIG. 1A. In addition, in the following description, in a case where K, C, M, and Y are not distinguished, K, C, M, and Y, which are attached to reference signs, are omitted.

The droplet drying device 14 is disposed on the downstream side of the head unit 26 in the paper transporting direction and dries an image formed on the continuous paper P. The droplet drying device 14 according to the exemplary embodiment includes plural light emitting elements (light sources) as heat sources for drying the image formed on the continuous paper P. For example, a semiconductor laser or a light emitting diode (LED) is used as the light emitting element as the heat source. A type of semiconductor laser is not limited to an edge-emitting type, and, in the exemplary embodiment, a vertical cavity surface emitting laser (VCSEL) element is used.

The feed roll 22 is a portion that supplies the continuous paper P to the head unit 26 and the continuous paper P is wound around the roll. The feed roll 22 is rotatably supported by a frame member (not shown).

The winding roll 24 is a portion at which the continuous paper P, on which the image is formed, is wound around the roll. The winding roll 24 receives a rotational force from a motor (not shown) and rotates, and thereby the continuous paper P is transported in the paper transporting direction.

The controller 20 controls the respective members of the image forming apparatus 10, collectively. In addition, the controller 20 functions also as a generation unit that generates a timing patch to be described below.

The image forming apparatus 10 configured as described above operates as follows. In other words, the winding roll 24 is rotated, then, tension in the paper transporting direction is applied to the continuous paper P, and the continuous paper P supplied from the feed roll 22 is transported in the paper transporting direction. The ink droplet lands on the front surface of the continuous paper P, which is transported in the paper transporting direction, first, by the head unit 26, and an image is formed on the front surface. The continuous paper P, on which the image is formed, is transported to the droplet drying device 14 and is dried.

Figure 1B:
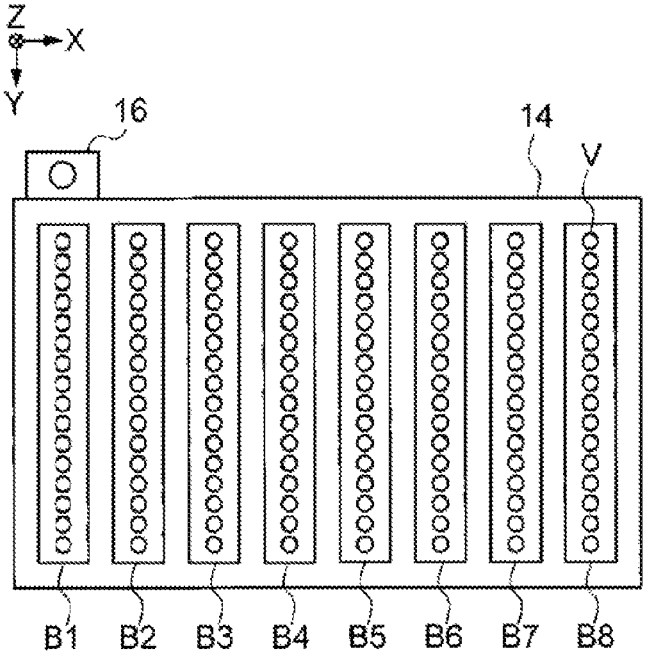

Next, the droplet drying device 14 according to the exemplary embodiment will be described with reference to FIG. 1B. As shown in FIG. 1B, the droplet drying device 14 includes plural (a case of eight shown in FIG. 1B) light emitting blocks B1 to B8 (hereinafter, referred to as "light emitting blocks B" in a case of being collectively described) arranged in a direction (X-axial direction, main scanning direction, paper width direction) orthogonal to (intersection with) the paper transporting direction (sub-scanning direction). In addition, each of the light emitting blocks B includes plural (a case of 16 shown in FIG. 1B) light emitting elements V arranged in the paper transporting direction, and each of the light emitting elements V emits light in a case where the continuous paper P, on which the image is formed, is dried.

As shown in FIG. 1B, the droplet drying device 14 is provided with a sensor 16. As will be described below, the sensor 16 has a function of reading an image (timing patch) formed on the continuous paper P, which is used to control a light emission timing of the light emitting element. A photosensor (reflective sensor), a barcode reading sensor, an image sensor (imaging element), or the like, is used as the sensor 16 according to the exemplary embodiment, without particular limitation to the sensor. In the exemplary embodiment, a photosensor having a simple configuration and available at a low cost is used.

Note that, in the exemplary embodiment, an example, in which the droplet drying device 14 includes eight light emitting blocks B and each of the light emitting blocks includes 16 light emitting elements V, is described; however the number of the light emitting blocks B and the light emitting elements V is not limited thereto, and the appropriate number may be selected according to required drying capacity or the like. In addition, the light emitting element V may be not only a single light emitting element, but also a light emitting element array in which plural light emitting elements are arranged in an array shape.

In general, light intensity of the light emitting element is controlled by a drive current flowing to the light emitting element and, in the droplet drying device 14 according to the exemplary embodiment, light intensity is also controlled by the drive current flowing to the light emitting element V. In the droplet drying device 14 according to the exemplary embodiment, as an example, the drive current is controlled by unit of the light emitting block B and thus, a drive circuit (driver, not shown), which controls drive current for each of the light emitting blocks B is connected to the droplet drying device. Note that, in the exemplary embodiment, an example, in which the drive current is controlled by unit of the light emitting block B, is described; however, the configuration is not limited thereto, and, for example, the drive current may be controlled by unit of the light emitting element V.

Next, an electrical configuration of the droplet drying device 14 will be described with reference to FIG. 2. As shown in FIG. 2, an electric system of the droplet drying device 14 includes the sensor 16, a RAM 28, the light emitting block B, and the light source controller 18.

As described above, the sensor 16 read the timing patch formed as an image on the continuous paper P. The RAM 28 temporarily stores image information of the timing patch read by the sensor 16. The light source controller 18 reads the image information of the timing patch from the RAM 28, generates light emitting control information of the light emitting blocks B, and controls light emission from the light emitting blocks B based on the light emitting control information. For example, a central processing unit (CPU) is used as the light source controller 18 according to the exemplary embodiment; however, a simple controller that is mainly dedicated to light emitting control of the light emitting blocks B may be used, and a 4 bit microcomputer is used as an example.

Incidentally, in the droplet drying device using the light emitting element, a light emission intensity (amount of drying heat) with respect to a surface of a recording medium is finely controlled, depending on concentration distribution of the ink in the image formed on the recording medium. In this case, a controller of the image forming apparatus (corresponding to the controller 20 in FIG. 1A) controls a light emission timing of each of the light emitting elements, based on image information (concentration distribution of ink or the like) of an image to be formed. Therefore, the controller of the image forming apparatus need to transmit, to the droplet drying device, information on light emission timing of each of the light emitting elements, along with image information (a position, a size, or the like, of the image).

However, in a state in which information needs to be transmitted or received between the controller and the droplet drying device as described above, interfaces for the transmission or reception need to be provided for both, and an electrical harness (bundle of wires) that connects the controller with the droplet drying device is needed. Thus, as long as such a configuration is employed, it is difficult to reduce costs, and there is limitation to flexibility in disposition of the droplet drying device in the image forming apparatus.

In the exemplary embodiment, a specifying image (timing patch), which specifies an element that emits light and a light emission timing for each of the elements, is formed on the recording medium. Meanwhile, a sensor for reading the specifying image is provided in the droplet drying device, the specifying image is read by the sensor, and the respective elements emit light in accordance with conditions specified in the read specifying image. In this manner, transmission/reception interfaces provided in the droplet drying device and the controller of the image forming apparatus, and wires therebetween are omitted in the related art. Therefore, manufacturing costs are reduced, flexibility in the disposition in the image forming apparatus is increased, and a droplet drying device and an image forming apparatus which have simpler configurations are provided.

Next, the light emitting control of the light emitting elements V (light emitting blocks B) according to the exemplary embodiment will be described in detail with reference to FIGS. 3A to 6B.

Figure 3A:
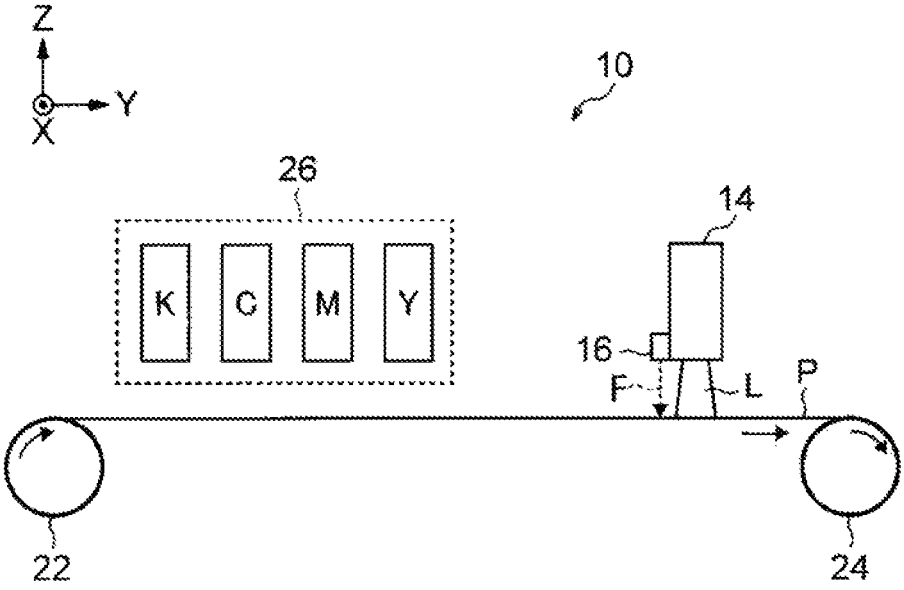
FIGS. 3A and 3B are views depicting reading of a timing patch according to a first exemplary embodiment.

FIG. 3A is a side view of the image forming apparatus 10 according to the exemplary embodiment and FIG. 38 is a plan view thereof. As shown in FIG. 3A, irradiation light L for drying the image formed on the continuous paper P is emitted from the light emitting blocks B of the droplet drying device 14. Meanwhile, projection light F for reading the timing patch is emitted from the sensor 16. The projection light F is reflected from the front surface of the continuous paper P and reflected light (not shown) including image information of the timing patch returns to the sensor 16. In this manner, the sensor 16 acquires the image information obtained by reading the timing patch.

Figure 3B:
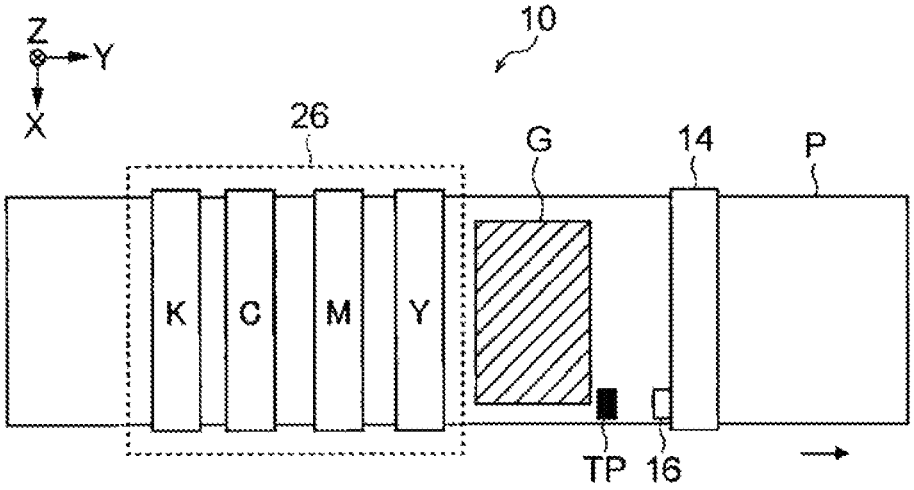

As shown in FIG. 3B, the head unit 26 forms an image G which is to be formed and a timing patch TP on the continuous paper P. The timing patch TP is formed, based on image information of the image G by the controller 20. More specifically, for example, the timing patch TP is formed, using a result obtained by image processing performed on the image information of the image G through filters divided into regions depending on amounts of ink indicated by the image information.

The timing patch TP includes information on at least one of a period of light emission start time (light emission timing), a period of standby time for light emission, a width of irradiation, oran intensity of light emission of the light emitting blocks B. The timing patch TP is formed, for example, at a position (a boundary region between pages on the continuous paper P) before an image (image G) which is formed within one page in the paper transporting direction. In addition, in the paper width direction of the continuous paper P, the timing patch is formed on a registration matching side (side on which the width direction of the continuous paper P is positioned, that is, side on which positions of pieces of continuous paper P having different widths are not changed). There is no particular limitation to the timing patch TP, as long as the timing patch is an image including information of the light emission timing or the like. For example, a one-dimensional barcode, a two-dimensional barcode (QR code (registered trademark)), or the like, is used as the timing patch. In addition, not only one but also a number of timing patches TP may be provided as necessary.

Figure 4:
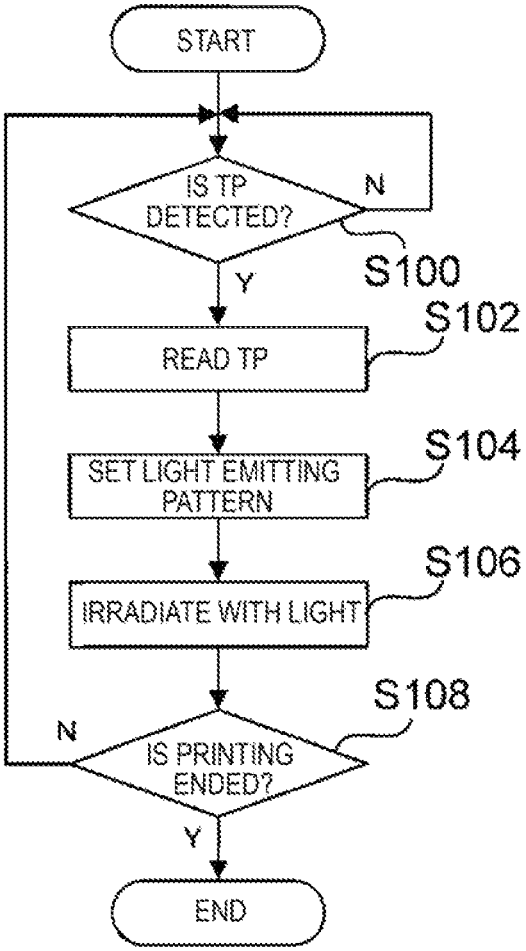
FIG. 4 is a flowchart showing a procedure of light emitting control according to the exemplary embodiment.

Next, a procedure of the light emitting control according to the exemplary embodiment will be described with reference to FIG. 4. The procedure in FIG. 4 is stored in a memory such as a read only memory (ROM) (not shown) by creating a program in accordance with a flowchart in FIG. 4, and the procedure may be executed by the light source controller 18.

First, in Step S100, the process is on standby until the timing patch TP is detected.

In a case where the timing patch TP is detected in Step S100, the sensor 16 is controlled to read the timing patch TP in Step S102.

Next, in Step S104, the light emission timing of the light emitting blocks B in the droplet drying device 14 is set, based on the image information of the timing patch TP read in Step S102.

Then, in Step S106, the light emitting blocks B emit light, based on the light emission timing set in Step S104, the image G formed on the continuous paper P is irradiated with the irradiation light L.

Then, in Step S108, it is determined whether printing (image forming) is ended. In a case of a negative determination, the process returns to Step S100, and the detection of the timing patch TP is continued. On the other hand, in a case of positive determination, the light emitting control is ended. Note that whether the printing is ended may be determined by determining whether an amount of printing reaches a pre-registered number of sheets of an original.

The light emission of the light emitting blocks B of the droplet drying device 14 according to the exemplary embodiment is controlled by the procedure described above, and the image G formed on the continuous paper P is dried.

Figure 5A:
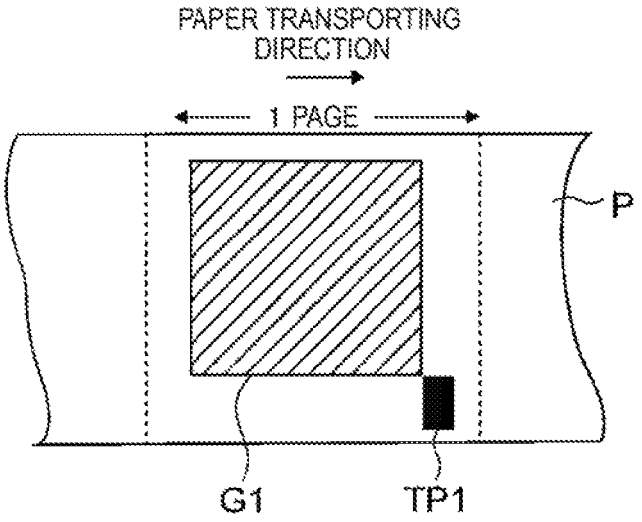
FIGS. 5A and 5B are views depicting a timing patch according to the first exemplary embodiment.
Figure 5B:
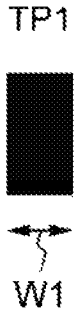
Figures 6A, 6B:
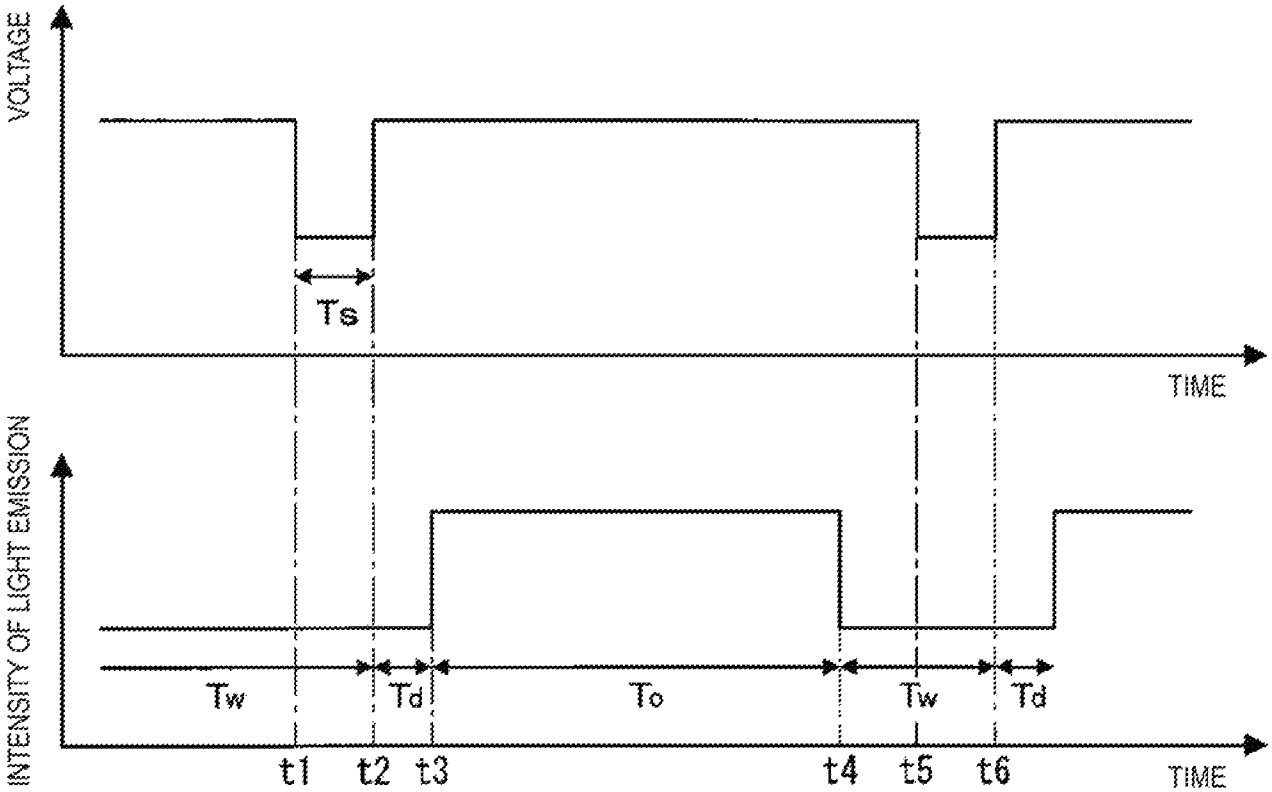
FIGS. 6A and 6B are timing charts depicting a relationship between a reading timing of the timing patch according to the first exemplary embodiment and a light emission timing of a light emitting block.

Next, the timing patch TP according to the exemplary embodiment will be described further in detail with reference to FIGS. 5A to 6B. FIGS. 5A and 5B are plan views showing a timing patch TP1 according to the exemplary embodiment, and FIGS. 6A and 6B are timing charts showing relationships between a timing of reading the timing patch TP1 and the light emission timing of the light emitting blocks B.

As shown in FIG. 5A, the timing patch TP1 is formed in front of an image G1 at a leading portion of an image forming region corresponding to one page of the continuous paper P in the paper transporting direction. There is no particular limitation to a color of the timing patch TP1, and, in the exemplary embodiment, the block color, from which the projection light F is less reflected, is used. In addition, there is no particular limitation to a pattern of the timing patch TP1, and, in the exemplary embodiment, a solid pattern is used.

As shown in FIG. 5B, in the exemplary embodiment, W1 represents a width of the timing patch TP1 in the paper transporting direction and the width W1 corresponds to a period of light emission time of the light emitting blocks B. In other words, the period of light emission time is set by multiplying a predetermined coefficient to a period of reading time of the timing patch TP1 having the width W1. In addition, in the exemplary embodiment, the light emitting blocks B1 to B8 are simultaneously turned on. In other words, the irradiation with the irradiation light L is uniformly performed in the width direction of the continuous paper P.

Next, the relationship between a timing of reading the timing patch TP1 and the light emission timing of the light emitting blocks B will be described with reference to FIGS. 6A and 6B. FIG. 6A shows a temporal waveform of a voltage when the sensor 16 reads the timing patch TP1, and FIG. 6B shows a temporal waveform of an intensity of the light emission when the light emitting blocks B emit light, based on the light emitting control information included in the read timing patch TP1.

In FIG. 6A, the sensor 16 starts reading the timing patch TP1 at a time point t1, and ends the reading at time point t2. In other words, a period of detection time of timing patch TP1 by the sensor 16 is that Ts=t2−t1, and Ts corresponds to a period of reading time of the width W1 of the timing patch TP1 shown in FIG. 5B.

By comparison, as shown in FIG. 6B, the droplet drying device 14 starts light emission from a time point t3 after a period of delay time Td elapses from the time point t2, emits light for a period of light emission time To, and end the light emission at a time point t4. As described above, the period of light emission time To is determined by multiplying a predetermined coefficient c to a period of reading time of the width W1 of the timing patch TP1, that is, to a period of detection time Ts. In other words, To=c*Ts. A period of standby time Tw is a period of time during which the droplet drying device 14 is on standby for a trigger for a start of the light emission. In FIG. 6A, reading of the next timing patch is started at time point t5, and the reading is ended at time point t6.

The period of delay time Td is a period of time from the end (time point t2) of the reading by the sensor 16 to a time point at which the leading end of the image G1 reaches the droplet drying device 14. The period of delay time Td is set depending on a distance between the timing patch TP1 and the image G1. It is needless to say that, when the distance between the timing patch TP1 and the image G1 is very close to each other, Td may be set to 0 or a value close to 0. In addition, the period of delay time Td may be normally set to a fixed value; however, since the period of delay time depends on a transport speed of the continuous paper P, a configuration, in which a user of the image forming apparatus 10 adjusts the period of delay time, may be employed.

The exemplary embodiment provides the droplet drying device and the image forming apparatus which have simpler configurations are provided, in which, in a case where the droplet drying device using the light source dries the recording medium on which the image is formed, congestion of connection with a controller is avoided, compared to a case where the controller of the image forming apparatus controls the droplet drying device. Additionally, since the wires between the droplet drying device and the controller of the image forming apparatus are omitted, flexibility in a mounting position of the droplet drying device in the image forming apparatus is increased. Further, the droplet drying device can be configured to be movable in the image forming apparatus. Therefore, when the droplet drying device is caused to move according to types of recording mediums to the like that have different permeability of the ink from each other or the like, and the light emission timing is adjusted, the droplet drying device performs a more appropriate drying operation.

Second Exemplary Embodiment

Another droplet drying device and another image forming apparatus according to the exemplary embodiment are described with reference to FIGS. 7A and 7B. The exemplary embodiment is an example in which a shape of the timing patch TP in the exemplary embodiment described above is changed, and an example corresponding to a case where an image to be formed is divided in one page of the continuous paper P.

Figure 7A:
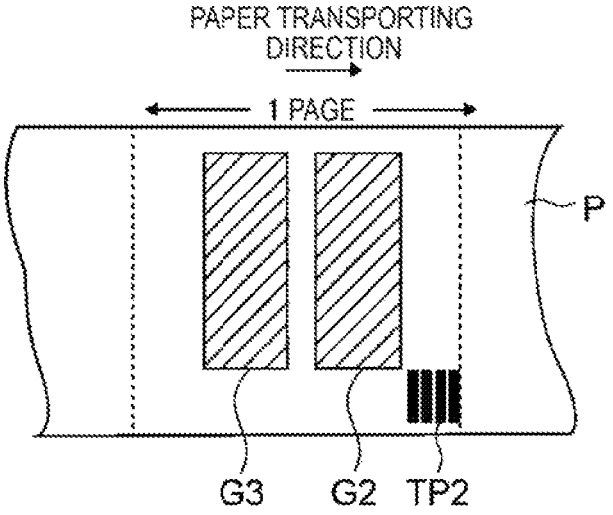
FIGS. 7A and 7B are views depicting a timing patch according to a second exemplary embodiment.

As shown in FIG. 7A, in the exemplary embodiment, the image to be formed is divided into two images G2 and G3 in a region corresponding to one page of the continuous paper P. Also, a timing patch TP2 is formed in a leading region in the one page in the paper transporting direction. Note that the division into the images G2 and G3 may mean not only division corresponding to an image of an original, but also division corresponding to a difference in an amount of the ink discharged from the inkjet head 12 between the images G2 and G3 when and an image is formed.

Figure 7B:
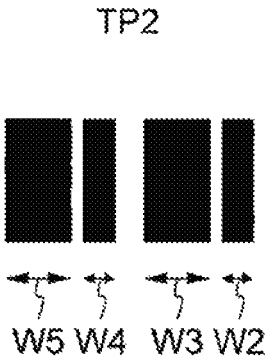

FIG. 7B shows details of the timing patch TP2. As shown in FIG. 7B, the timing patch TP2 has black patches having widths of W2, W3, W4, and W5, respectively. Hereinafter, the patterns having the widths W2, W3, W4, and W5 are referred to as patterns W2, W3, W4, and W5, for convenience. In the exemplary embodiment, the patterns W2 and W3 include light emitting control information of the droplet drying device 14 with respect to the image G2, and the patterns W4 and W5 include light emitting control information of the droplet drying device 14 with respect to the image G3. Thus, the timing pattern TP2 is called a type of one-dimensional barcode.

More specifically, the pattern W2 indicates a period of light emission start time (light emission timing) of the light emitting blocks B with respect to the image G2, and the pattern W3 indicates a period of irradiation time with respect to the image G2. Meanwhile, the pattern W4 indicates a period of light emission start time (light emission timing) of the light emitting blocks B with respect to the image G3, and the pattern W5 indicates a period of irradiation time with respect to the image G3. Here, the patterns W2 and W4 may be set in the same consideration as the period of delay time Td described above. In other words, the patterns W2 and W4 may be set to define a difference in a period of time from a time point of ending the reading of the timing patch TP2 to a time point of starting the light emission of the light emitting blocks B.

According to the exemplary embodiment, even in a case where an image to be formed in one page is divided, an amount of irradiation of the light emitting blocks B is changed for each of divided images.

Third Exemplary Embodiment

Still another droplet drying device and still another image forming apparatus according to the exemplary embodiment are described with reference to FIGS. 8A to 8C. The exemplary embodiment is an example in which a shape of the timing patch TP in the exemplary embodiment described above is changed, and an example corresponding to a case where an image to be formed is finely divided into both directions of the paper transporting direction and the paper width direction in one page of the continuous paper P.

Figure 8A:
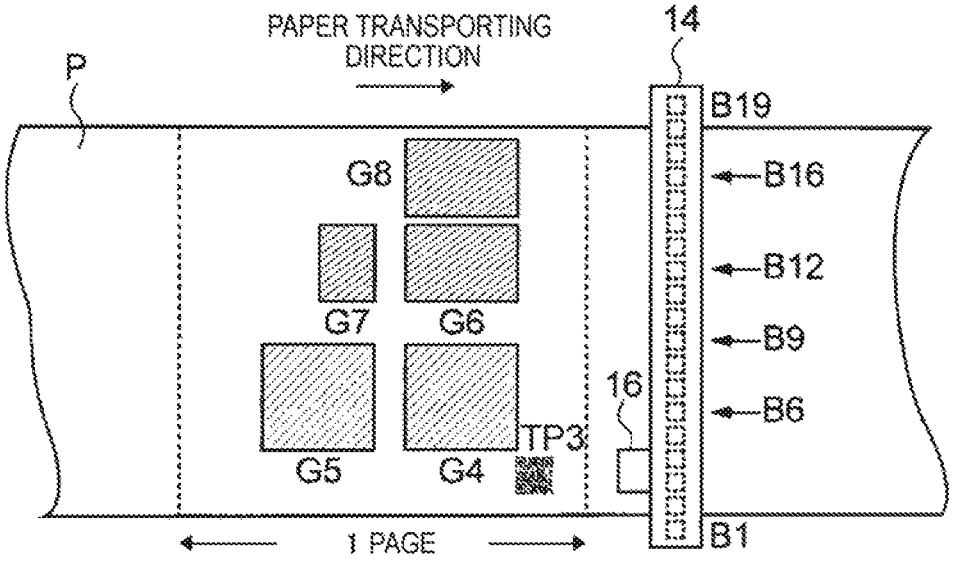

As shown in FIG. 8A, in the present exemplary embodiment, the image in one page is divided into two images G4 to G8. Also, a timing patch TP3 is formed in a leading region in the one page in the paper transporting direction. The droplet drying device 14 according to the exemplary embodiment includes nineteen (19) light emitting blocks of light emitting blocks B1 to B19 arranged in the paper width direction. Here, a set of the images G4, G6, and G8 arranged in the paper width direction is referred to as an image group 1 and a set of the images G5 and G7 arranged in the paper width direction is referred to as an image group 2.

Figure 8B:
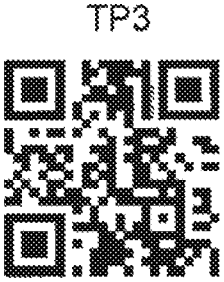

FIG. 8B shows the timing patch TP3 according to the exemplary embodiment. As shown in FIG. 8B, the timing patch TP3 according to the exemplary embodiment is formed using a so-called QR code (registered trademark). The QR code (registered trademark) is a type of two-dimensional barcode, and is effective in a case where more information is included than in the one-dimensional barcode.

FIG. 8C shows light emitting control information included in the timing patch TP3. As shown in FIG. 8C, the timing patch TP3 includes information on a "light emitting block number", a "period of start time", a "period of light emission time", and an "intensity of light emission". The "light emitting block number" indicates the numbers B1 to B19 of the light emitting blocks B shown in FIG. 8A. The "period of start time" indicates a period of time during which the light emitting blocks B starts emitting light, that is, the light emission timing, and, in the exemplary embodiment, indicates the period of delay time Td described above. The "period of light emission time" indicates a period of time during which the light emitting blocks B emit light, that is, a period of irradiation time. The "intensity of light emission" indicates an intensity of light emission of the light emitting blocks B, and, in the exemplary embodiment, indicates a ratio in a case where the maximum intensity of light emission of the light emitting blocks B is 100%. In this manner, in the exemplary embodiment, in order to control a more accurate amount of drying heat according to a size of an image formed on the continuous paper P, the intensity of the light emission is also controlled.

In FIG. 8C, a "period of start time 1", a "period of light emission time 1", and an "intensity of light emission 1" indicate that the information is the light emitting control information with respect to the image group 1, and a "period of start time 2", a "period of light emission time 2", and an "intensity of light emission 2" indicate that the information is the light emitting control information with respect to the image group 2. As shown in FIG. 5A, the image group 1 reaches the droplet drying device 14 earlier than the image group 2.

As shown in FIG. 8A, regarding the image group 1, a light emitting block B that dries the image G4 corresponds to the light emitting block B6, a light emitting block B that dries the image G6 corresponds to the light emitting block B12, and a light emitting block B that dries the image G8 corresponds to the light emitting block B16. In addition, regarding the image group 2, a light emitting block B that dries the image G5 corresponds to the light emitting block B6 and a light emitting block B that dries the image G7 corresponds to the light emitting block B12. It is needless to say that it is not necessary that one light emitting block B dries each of the images, and plural light emitting blocks B dry each of the images, according to an amount of heat to be applied.

Here, a method of description of the light emitting control information corresponding to each of the images is defined as follows. In other words, the light emitting control information with respect of an image k (k=4 to 8) of an image group j (j=1 and 2), corresponding to a light emitting block number i (i=1 to 19), is described as Cj (Gk)=(a light emitting block number i, a period of start time j, a period of light emission time j, an intensity of light emission j). In this case, the light emitting control information on the image G4 is C1 (G4)=(6, 2 msec, 10 msec, 80%) from FIG. 8C.

With reference to FIG. 8C, similarly, items of the light emitting control information on images G5 to G8 are described as follows. C1 (G6)=(12, 2 msec, 10 msec, 100%), C1 (08)=(16, 2 msec, 10 msec, 50%), C2 (G5)=(6, 4 msec, 10 msec, 80%), and C2 (G7)=(12, 4 msec, 5 msec, 50%).

In the exemplary embodiment, the light emitting blocks B are controlled based on the light emitting control information configured by the timing patch TP3 as described above.

As described above, according to the exemplary embodiment, even in the case where the image formed on the continuous paper P is finely divided in the paper transporting direction and in the paper width direction, an appropriate amount of drying heat is applied to each of the divided images.

Note that, in the exemplary embodiments described above, the example, in which the sensor 16 is provided to be integral with the droplet drying device 14, is described; however, the sensor 16 may be disposed at any position in the image forming apparatus 10 as long as the sensor reads the timing patch TP at the position. In this case, a change in the light emission timing due to a distance between the sensor 16 and the droplet drying device 14 is adjusted, for example, by the period of delay time Td.

In addition, in the exemplary embodiments described above, the example, in which the head unit 26 forms the image of the timing patch TP, is described; however, the configuration is not limited thereto, and an example, in which an inkjet head dedicated to a timing patch TP formed with only black is provided, may be employed.

In addition, in the exemplary embodiments described above, the example, in which the light emitting blocks B are arranged in the paper width direction, is described; however, the configuration is not limited thereto, and an example, in which the light emitting blocks B are arranged in the paper transporting direction, may be employed.

In addition, in the exemplary embodiments described above, the example, in which the continuous paper is used as the recording medium, is described; however, the configuration is not limited thereto, and an example, in which a recording sheet cut to have a uniform size, that is, a so-called cut sheet, is used as the recording medium, may be employed.

In addition, in the exemplary embodiments described above, the example, in which the invention is applied to single-side printing, is described; however, the invention is not limited thereto, and the invention may be applied to duplex printing.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet drying device, disposed on a downstream side of a forming unit in a transporting direction of a recording medium, the droplet drying device comprising:

a light source that irradiates, with light, and dries a droplet ejected to the recording medium by the forming unit that ejects the droplet to form an image;

a reading unit that reads a specifying image in which a light emitting condition of the light source is specified and which is formed by the forming unit in a region out of an image forming region on the recording medium; and a light source controller that controls the light source such that the light source emits light in accordance with the light emitting condition specified in the specifying image read by the reading unit so as to irradiate the droplet with the light.

2. The droplet drying device according to claim 1, wherein a region out of the image forming region is a region located in front of the image forming region within a unit page with respect to a transporting direction of the recording medium, or a region on a side on which the recording medium is positioned in a direction intersecting with the transporting direction.

3. The droplet drying device according to claim 1, wherein the specifying image includes information on at least one of a period of time during which the light source starts emitting light, a period of time during which the light source is on standby to emit light, a period of time during which the recording medium is irradiated with the light, a width of the recording medium which is irradiated with the light in a direction intersecting with the transporting direction of the recording medium, or an intensity of the light emitted from the light source.

4. The droplet drying device according to claim 1, wherein the specifying image is a one-dimensional barcode or a two-dimensional barcode.

5. The droplet drying device according to claim 1, wherein the specifying image is formed with the droplets having a black color.

6. The droplet drying device according to claim 1, wherein the reading unit is a photosensor.

7. The droplet drying device according to claim 1, wherein the light source includes a plurality of surface emitting semiconductor laser elements that are arranged in a two-dimensional manner.

8. The droplet drying device according to claim 7, wherein the light source includes unit light sources in each of which a predetermined number of the surface emitting semiconductor laser elements are arranged in a transporting direction of the recording medium, a predetermined number of columns of the unit light sources being arranged in a direction intersecting with the transporting direction, and the light source controller controls light emission of each of the plurality of unit light sources.

9. The droplet drying device according to claim 1, wherein after the reading unit reads the specifying image, the light source controller controls the light source such that the droplet is irradiated with the light after a predetermined period of time elapses.

10. An image forming apparatus comprising:

a forming unit that ejects a droplet to form an image;

the droplet drying device according to claim 1 that is disposed on a downstream side of the forming unit in a transporting direction of the recording medium; and a generation unit that generates the specifying image based on image information of an image formed by the forming unit.

11. The image forming apparatus according to claim 10, wherein the generation unit divides the image into a plurality of regions depending on an amount of the droplet that is specified in the image information, sets the light emitting condition of the light source for each of the plurality of regions, and generates the specifying image.

12. The image forming apparatus according to claim 10, wherein the recording medium is a paper roll.

13. A droplet drying device, disposed on a downstream side of a first forming unit in a transporting direction of a recording medium, the droplet drying device comprising:

a light source that irradiates, with light, and dries a droplet ejected to the recording medium by the first forming unit that ejects a droplet to form an image;

a reading unit that reads a specifying image in which a light emitting condition of the light source is specified and which is formed in a region out of an image forming region on the recording medium, by a second forming unit different from the first forming unit that ejects the droplet and forms the image; and a light source controller that controls the light source such that the light source emits light in accordance with the light emitting condition specified in the specifying image read by the reading unit so as to irradiate the droplet with the light.

* * * * *